US005219118A

United States Patent [19]

Callahan

[11] Patent Number: 5,219,118

[45] Date of Patent: Jun. 15, 1993

[54] OCTAGONAL FOLDABLE TOP CAP

[75] Inventor: Scott Callahan, Pittsburgh, Pa.

[73] Assignee: Karl Shields Associates, Pittsburgh, Pa.

[21] Appl. No.: 869,542

[22] Filed: Apr. 15, 1992

[51] Int. Cl.[5] ..... B65D 43/08

[52] U.S. Cl. ..... 229/125.19; 229/109; 229/166; 229/181

[58] Field of Search ..... 229/166, 109, 125.19, 229/178, 165, 181

[56] References Cited

U.S. PATENT DOCUMENTS

| | | | |
|---|---|---|---|
| 2,163,060 | 6/1939 | Ray | 229/109 |
| 2,698,126 | 12/1954 | Belsinger | 229/166 |
| 2,723,073 | 11/1955 | Fellowes | 229/166 |
| 3,136,473 | 6/1964 | Kieffer | 229/166 |
| 3,261,533 | 7/1966 | Repking | 229/109 |
| 3,477,633 | 11/1969 | Greene et al. | 229/181 |
| 3,675,764 | 7/1972 | Dutcher | 229/117.07 |
| 3,907,194 | 9/1975 | Davenport et al. | 229/109 |
| 4,742,915 | 5/1988 | Ringer | 229/109 |

*Primary Examiner*—Allan N. Shoap
*Assistant Examiner*—Christopher J. McDonald
*Attorney, Agent, or Firm*—Buchanan Ingersoll; George Raynovich, Jr.

[57] ABSTRACT

A rigid foldable cover to provide protection from damage from the elements or from mechanical injuries for generally round objects, such as coiled sheet metal. The cover is octagonal in shape and is fabricated from a flat central panel having eight sides with a foldable side panel at each of the eight sides of the central panel. The eight side panels are secured to each other and bent to a right angle position with respect to the central panel to form a continuous skirt around the central panel.

4 Claims, 2 Drawing Sheets

OCTAGONAL FOLDABLE TOP CAP

BACKGROUND OF THE INVENTION

This invention relates to a top cap or cover of fiberboard or other rigid but foldable material to provide outdoor protection from the elements for metal or other material which is otherwise exposed to rain or other precipitation or to mechanical injury. More particularly, this invention relates to an octagonal cover protection for generally round objects such as coiled sheet aluminum or steel. The octagonal shape of the cover allows the shape of the cover to approximate the shape of a circular or coiled object which is covered.

SUMMARY OF THE INVENTION

This invention relates to a flat form of fiberboard or other rigid but foldable material such as non-woven polypropylene having perforated fold lines adapting it to be assembled into an octagonal cover. The assembled cover is further adapted to be collapsed after being assembled so that a plurality of collapsed covers can be stacked for shipment. This invention also relates to the method for assembling and collapsing the fiberboard panels.

The flat rigid form adapted to be folded into an octagonal cover comprises an octagonal central panel having eight edges with each of the edges defined by a central panel perforated fold line. Each of the edges has a folding panel attached to the central at the central panel perforated fold line Although the folding panels are attached to the central panel, the panels in the form are not attached to each other. The folding panels comprise alternating short extension and long extension folding panels. The long extension folding panels have a pair of parallel long extension panel fold lines, said lines also being parallel to their respective central panel perforated fold line, and said parallel fold lines defining an inner portion, an intermediate portion and an outer portion of each long extension folding panel. There are triangular tabs on each side edge of said short extension folding panels. Each tab is located adjacent to and abuts a corresponding edge of the inner portion of the long extension folding panel. There are at least three radial perforated lines flaring radially outwardly from a common point at each bottom edge of each short extension panel adjacent to each tab. The radial perforated lines are adapted to permit flexure at each edge of each short extension panel adjacent to its respective tab.

The flat form advantageously includes foldable reinforcement panels with each reinforcement panel secured in part to the surface of the central panel and in part to the surface of the inner portion of its respective long extension folding panel. Each reinforcement panel is foldable at the border of the central panel and the inner portion of the long extension folding panel. The segment of each reinforcement panel extending over the central panel is thicker in a region remote from said border as compared to its thickness in the region closest to the border to form a locking ledge whose function is described below. The reinforcement panels can be secured in place by any suitable means, such as by stapling or gluing.

This invention also relates to the assembled top cap or cover prepared from the flat panel and to the method of assembly. In the assembled cover, the short extension panels and the long extension panels are folded at said central panel perforated fold line 90 degrees with respect to said central panel so that said panels form a continuous skirt around said central panel. As a first step in the assembly, glue is applied to the surface of each inner portion of each long extension panel and to the central panel to facilitate attachment of the reinforcing panels and of the tabs. The reinforcing panels can be secured to the positions described above by gluing. The tabs on each side of each small extension panel are secured to the adjacent inner portions of each long extension panel by gluing. The long extension panels are then folded inwardly at each of said parallel perforated fold lines so that a space is provided between facing inner and outer portions of each long extension panel with the size of the space being established by the distance between the parallel fold lines and with tabs being secured at each end of said space so that alternating long extension panels and short extension panels are secured to each other and folded with respect to the central panel at the same time. The assembly is completed by lodging the outer edge of the outer portion of the long extension panel against the locking ledge so that the entire skirt is locked into a right angle position with respect to the central panel.

The assembled fiberboard box can be collapsed at the manufacturing site for shipment to the user by manually pressing the locked long extension panels downwardly towards the central panel while flexing the radial fold lines. The collapsed fiberboard boxes are inverted and a plurality of inverted boxes are stacked for shipment to the location of use.

BRIEF DESCRIPTION OF THE DRAWINGS

This invention will be more clearly understood by reference to the accompanying drawings in which.

DESCRIPTION OF THE PREFERRED EMBODIMENT

Figure 1:
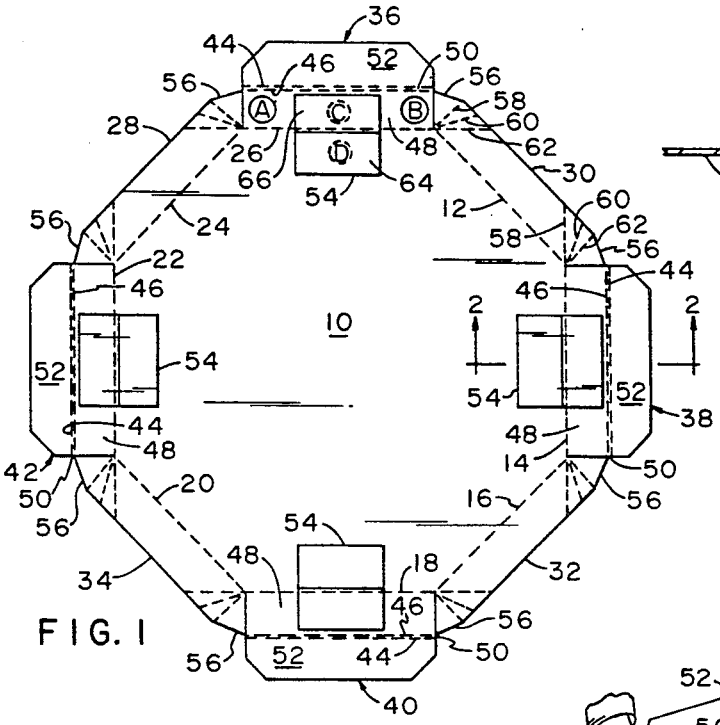
FIG. 1 shows a flat unfolded fiberboard form for the top cap with reinforcing panels attached.

The flat unassembled form of fiberboard or other material of FIG. 1 includes an octagonal central panel 10 having eight sides 12, 14, 16, 18, 20, 22, 24 and 26, each marked by a perforated central panel fold line. On the opposite side of the perforated central panel fold lines are short extension panels 28, 30, 32, and 34 which alternate with long extension panels 36, 38, 40 and 42. Each long extension panel has a pair of parallel perforated fold lines 44 and 46 which demark inner portion 48, intermediate portion 50 between the parallel fold lines and outer portion 52 of each long extension panel. Each set of parallel perforated fold lines 44 and 46 is also parallel to its respective perforated central panel fold line. Each side edge of each short extension panel 28, 30, 32 and 34 has a triangular tab 56 and inwardly thereof also has three radially extending perforated flex lines 58, 60 and 62, each extending from a common point on the bottom edge of the respective short extension panel 28, 30, 32 and 34. Elements 56, 58, 60 and 62 are marked for short extension panel 30 as illustrative of similar elements shown on short extension panels 28, 32 and 34.

Figure 2:
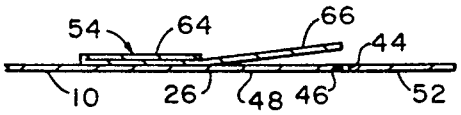
FIG. 2 is a side view showing the reinforcing panel and taken through the section 2—2 of FIG. 1.

The first step in the assembly operation involves the application of glue to four positions in and about each long extension panel 36, 38, 40 and 42. For illustrative purposes, the four positions of glue application are shown for panel 36, but it will be understood that glue will also be applied to corresponding positions on and near panels 38, 40 and 42. Referring to FIG. 1 and panel 36, spot application of glue is made to positions A, B and C on the surface of inner portion 48 and to position D on the surface of central panel 10 on the opposite side of perforated fold line 26 from position C. Thereupon, four reinforcement panels 54 are glued onto the surface of each inner portion 48 and the surface of central panel 10, as shown, with the fold line of each panel 54 overlying perforated fold lines 14, 18, 22 and 26, respectively. This procedure is shown in side view in FIG. 2. As shown in FIG. 2, segment 64 of reinforcement panel 54 which is glued to central panel 10 is substantially thicker, such as two-fold thicker, over most of its extent as compared to segment 66 of reinforcement panel 54 which is glued to the surface of inner portion 48 of the respective long extension panel. The reason for this additional thickness will be shown in FIG. 5.

Figure 3:
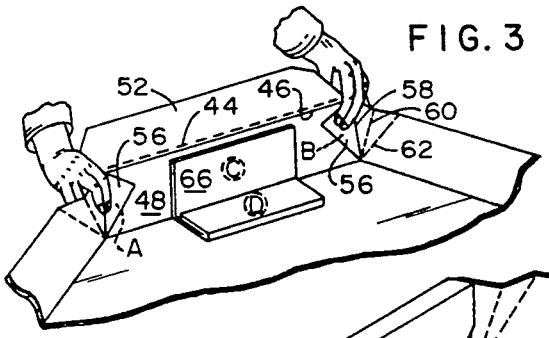
FIG. 3 shows an early step in the folding assembly operation of the top cap.

The next step in the assembly procedure is illustrated in FIG. 3 and comprises pulling each triangular tab 56 on each side of each long extension panel over the surface of each inner portion 48 and gluing each tab 56 at the glue locations A and B. The flexure at radial perforated lines 58, 60 and 62 facilitates the gluing of tabs 56 onto the surface of each inner portion 48. When tabs 56 are glued to the surface of each inner portion 48, the folding of each inner portion 48 to an angle of 90 degrees with respect to central panel 10 tends to force the short extension panels into a similar 90 degree folding position with respect to central panel 10.

Figure 4:
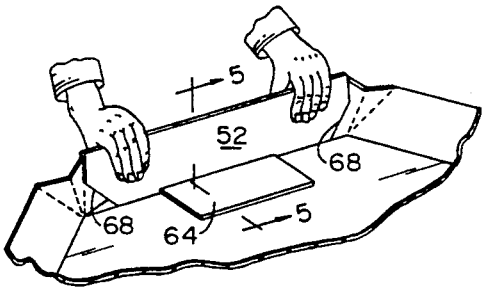
FIG. 4 shows a later step in the folding assembly operation of the top cap.
Figure 5:
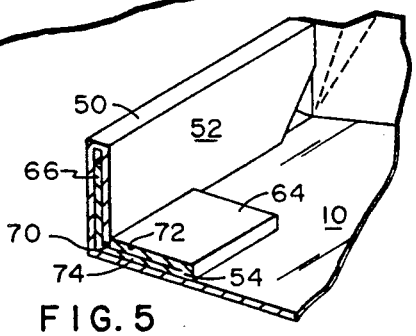
FIG. 5 is an isometric cross-sectional view of a fragment of the assembled top cap.

The next step in the assembly procedure is illustrated in FIGS. 4 and 5 which show outer portion 52 of a long extension panel folded 180 degrees by first folding 90 degrees at parallel perforated fold line 46 and then folding another 90 degrees at parallel perforated fold line 44 so that outer portion 52 covers and encloses two tabs 56 and segment 66 of reinforcing panel 54. Each outer portion has bevels 68 so that outer portion 52 avoids contact with the short extension panels during the folding operation.

FIG. 5 illustrates that reinforcement panel 54 provides a locking function as well as a reinforcing function. As shown in FIG. 5, segment 64 of the reinforcement panel which is glued to the surface of central panel 10 is two-ply with upper fold 72 securely glued to lower fold 74. However, FIG. 5 shows that upper fold 72 covers only a major portion lower fold 74, leaving uncovered a minor portion 70 close to reinforcing panel segment 66. FIG. 5 shows that outer portion 52 when folded over segment 66 is slipped into the space designated at 70 so that outer portion 52 is locked against unfolding by means of the inner edge of upper fold 72, which serves as a locking ledge.

Figure 6:
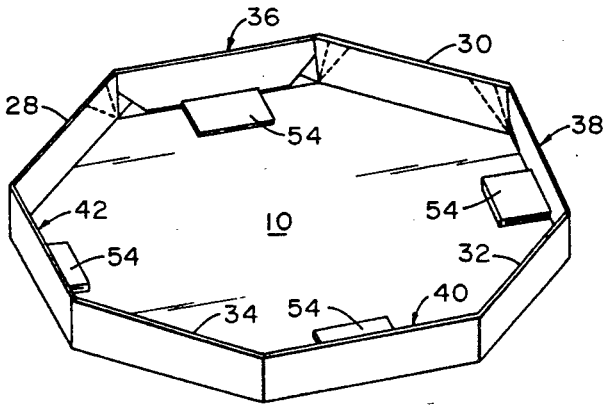
FIG. 6 is an isometric view of the entire assembled top cap.

FIG. 6 is an isometric view of an assembled cap top in which all the long extension panels and short extension panels are folded and interlocked in the manner illustrated in FIGS. 3 4 and 5. As shown in FIG. 6, the folding panels are all folded from the common, plane position with respect to the central panel shown in FIG. 1 to a right angle position with respect to the central panel so that the panels form a continuous skirt around the central panel.

Figure 7:
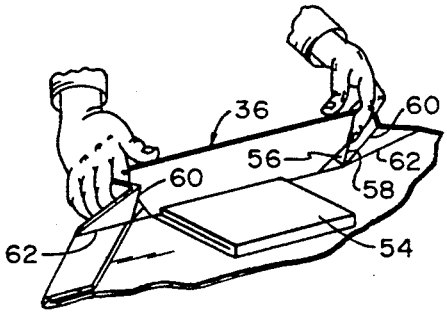
FIG. 7 shows an early step in the collapsing of an assembled top cap for stacking.
Figure 8:
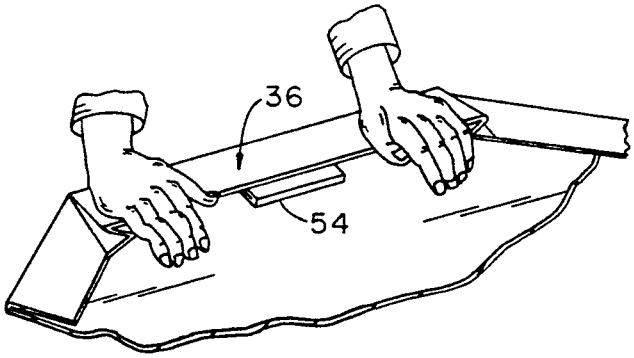
FIG. 8 shows a later step in the collapsing of an assembled top cap.
Figure 9:
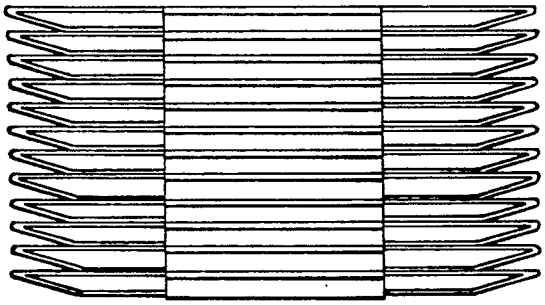
FIG. 9 shows a stack of assembled and collapsed top caps.

The top cap shown in FIG. 6 is assembled at an assembly plant. After assembly, each cap is manually collapsed into a relatively compact position by flexing the short extension panels at radial perforated lines 58, 60 and 62 while pressing down on long extension panels 36, as shown in FIGS. 7 and 8. The collapsed panels are then inverted and a plurality are stacked for shipment to the user, as shown in FIG. 9. The folded top caps are transported in an inverted arrangement to maintain them in the folded condition of FIG. 8.

It will be appreciated that the pair of hands represented in the operations of FIGS. 3 and 4 and FIGS. 7 and 8 represent the hands of a single operator at the top cap manufacturing plant. The operations represented in FIGS. 3 and 4 and 7 and 8 are performed simultaneously by four operators, standing in a circle around a table supporting the cap being assembled, each operator 90 degrees removed from the closest operator so that each stands at a respective long extension panel at which the work is being performed.

Figure 10:
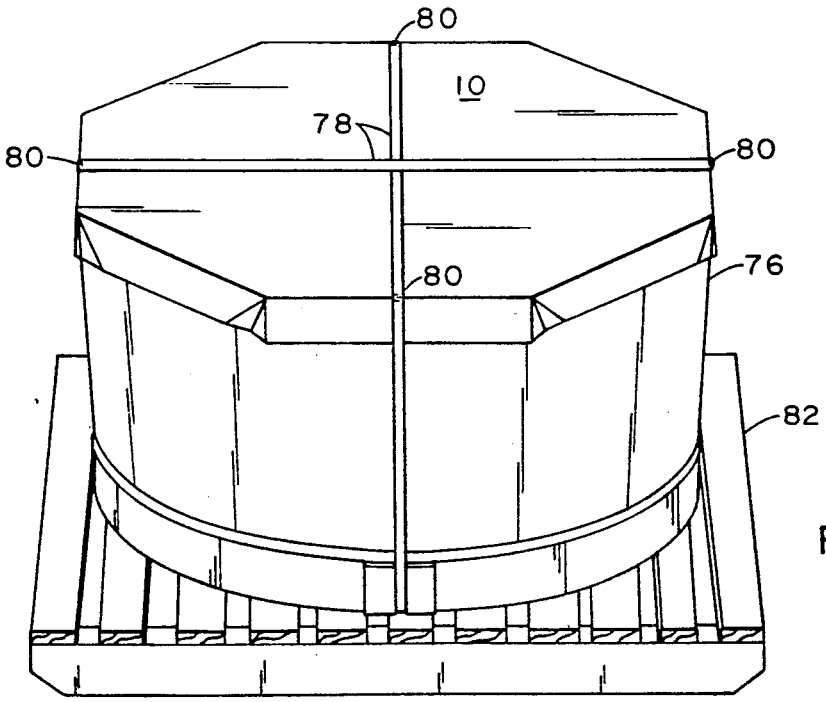
FIG. 10 shows a top cap strapped to a metal coil when in use.

FIG. 10 shows the top cap in use as a cover for sheet metal coil 76, which may be coiled aluminum or steel, to provide outdoor protection to the metal from the elements such as rain or other precipitation. The cap is fastened to the coiled metal by criss-crossing metal straps 78. Metal straps 78 bend from a horizontal to a vertical position at points 80 on the top cap. Points 80 are specifically selected to correspond to the location of reinforcement panels 54, not seen in FIG. 10. The metal coil-top cap assembly is shown on pallet 82, ready for movement or transport by a lift fork.

Reinforcement panels 54 can be of the same material as the main panel or can be of a different material, such as reinforced rubber, solid fiber, needled non-woven copolymer, etc. The reinforcement panels provide an edge damage protection function by providing an extra measure of protection from metal straps 78 or from pallet runners or by providing protection from transit strapping for load securement of folded panels.

I claim:

1. A flat form of rigid material adapted to be folded into an octagonal cover comprising an octagonal central panel having eight sides, each of said sides defined by a central panel perforated fold line, each of said sides having a folding panel attached to said central panel at said central panel perforated fold line, said folding panels comprising alternating short extension and long extension folding panels which are not connected with each other, said long extension folding panels having a pair of parallel long extension panel fold lines defining an inner portion, an intermediate portion an outer portion of each long extension folding panel, triangular tabs on each side of said short extension folding panels, said tabs located adjacent each edge of each inner portion of a respective long extension folding panel, at least three radial perforated lines flaring radially outwardly from a common point at each bottom edge of each short extension panel adjacent to each tab, said radial perforated lines adapted to permit flexure during folding at each edge of each short extension panel adjacent its respective tab, a plurality of foldable reinforcement panels each secured in part to the surface of said central panel and in part to the surface of the inner portion of its respective long extension folding panel, each reinforcement panel covering only a minor portion of the surface of the central panel so that most of the surface of the central penal is not covered by said reinforcement panels, each reinforcement panel being foldable at the border of said central panel and said inner portion of said long extension folding panel.

2. The form of claim 1 wherein said reinforcement panels are of a different material than said form.

3. The form of claim 1 wherein the segment of each reinforcement panel extending over said central panel is thicker in a region remote from said border as compared to its thickness in the region closest to said border.

4. The form of claim 1 wherein said reinforcement panels are secured in place by glue.

* * * * *

UNITED STATES PATENT AND TRADEMARK OFFICE

CERTIFICATE OF CORRECTION

PATENT NO. : 5,219,118

DATED : June 15, 1993

INVENTOR(S) : SCOTT CALLAHAN

It is certified that error appears in the above-identified patent and that said Letters Patent is hereby corrected as shown below:

Column 5, line 10, change "penal" to --panel--.

Signed and Sealed this

Fifteenth Day of March, 1994

*Attest:*

Bruce Lehman

BRUCE LEHMAN

*Attesting Officer*

*Commissioner of Patents and Trademarks*